US008456253B2

(12) United States Patent
Morgia

(10) Patent No.: US 8,456,253 B2
(45) Date of Patent: Jun. 4, 2013

(54) MICROSTRIP TO WAVEGUIDE COUPLER HAVING A BROADENED END PORTION WITH A NON-CONDUCTIVE SLOT FOR EMITTING RF WAVES

(75) Inventor: Fabio Morgia, Milan, MI (US)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/403,469

(22) Filed: Feb. 23, 2012

(65) Prior Publication Data

US 2012/0176285 A1 Jul. 12, 2012

Related U.S. Application Data

(63) Continuation of application No. PCT/CN2010/070971, filed on Mar. 10, 2010.

(51) Int. Cl.
*H01P 5/107* (2006.01)

(52) U.S. Cl.
USPC ..... 333/26; 333/34

(58) Field of Classification Search
USPC ..... 333/26, 34
See application file for complete search history.

(56) References Cited

U.S. PATENT DOCUMENTS

| | | | | |
|---|---|---|---|---|
| 6,396,363 | B1 * | 5/2002 | Alexanian et al. | 333/26 |
| 7,420,436 | B2 * | 9/2008 | Stenger | 333/26 |
| 7,436,361 | B1 | 10/2008 | Paulsen et al. | |
| 2004/0085151 | A1 | 5/2004 | Fukunaga | |
| 2004/0119564 | A1 | 6/2004 | Itoh et al. | |
| 2007/0216493 | A1 | 9/2007 | Stenger | |
| 2008/0100394 | A1 | 5/2008 | Margomenos et al. | |

FOREIGN PATENT DOCUMENTS

| | | | |
|---|---|---|---|
| CN | 1284761 | A | 2/2001 |
| CN | 1499667 | A | 5/2004 |
| CN | 101170214 | A | 4/2008 |
| CN | 101246992 | A | 8/2008 |
| EP | 1367668 | A1 | 12/2003 |
| EP | 1469548 | A1 | 10/2004 |
| JP | 2002208806 | A | 7/2002 |
| WO | WO 2008/060047 | A1 | 5/2008 |

OTHER PUBLICATIONS

International Search Report and Written Opinion of the International Searching Authority issued in corresponding PCT Patent Application No. PCT/CN2010/070971, mailed Dec. 16, 2010.

Extended European Search Report issued in corresponding European Patent Application No. 10847198.8, mailed Jun. 20, 2012.

* cited by examiner

*Primary Examiner* — Benny Lee

(74) *Attorney, Agent, or Firm* — Brinks Hofer Gilson & Lione

(57) ABSTRACT

The invention relates to a microstrip coupler for coupling a radio frequency, RF, wave into a waveguide. The microstrip coupler comprises a conductive microstrip line having a broadened end portion, and a non-conductive slot (105) following the broadened end portion to form an antenna for irradiating the RF wave.

5 Claims, 5 Drawing Sheets

PRIOR ART

PRIOR ART

MICROSTRIP TO WAVEGUIDE COUPLER HAVING A BROADENED END PORTION WITH A NON-CONDUCTIVE SLOT FOR EMITTING RF WAVES

CROSS-REFERENCE TO RELATED APPLICATION

This application is a continuation of International Application No. PCT/CN2010/070971, filed on Mar. 10, 2010, entitled "Microstrip coupler", which is hereby incorporated herein by reference.

BACKGROUND OF THE INVENTION

The present invention relates to radio frequency (RF) coupling.

In order to couple RF waves by microstrip lines into waveguides, a waveguide coupled arrangement as shown in FIG. 4 may be employed. In particular, a microstrip line 401 which is guiding the RF wave terminates at a microstrip feeder 403 above which a waveguide 405 is arranged. Below the microstrip feeder, a short circuit, e.g. a $\lambda/4$ waveguide 407 may be arranged.

FIG. 5 shows an upper view at the waveguide coupling arrangement of FIG. 4. As shown in FIG. 5, the microstrip feeder 403 has a rectangular, conductive end for coupling the RF wave into the waveguide 405 (FIG. 4). In order to couple the RF wave into the waveguide 405, the $\lambda/4$ waveguide 407 (FIG. 4) is provided. Further, a ribbon 501 of ground vias close to the microstrip line 401 is arranged.

SUMMARY OF THE INVENTION

One of the goals of the present disclosure is to provide a more efficient concept for coupling radio frequency waves from a microstrip line towards a waveguide.

The present disclosure is based on the finding that a more efficient RF coupling concept may be provided if the RF wave is emitted by a slot which is surrounded by a conductive plane which is in contact with the microstrip line and which, optionally, may be grounded.

According to an aspect, the invention relates to a microstrip coupler for coupling a radio frequency (RF) wave into a waveguide. The microstrip coupler comprises a conductive microstrip line having a broadened end portion, and a non-conductive slot following the broadened end portion to form an antenna for emitting the RF wave.

According to an implementation form, the non-conductive slot is formed in a conductive plane contacting to the broadened end portion.

According to an implementation form the conductive plane is grounded.

According to an implementation form, the broadened end portion is tapered.

According to an implementation form, the conductive microstrip line and the broadened end portion are arranged on a dielectric substrate.

According to an implementation form, the non-conductive slot may be rectangular.

According to an implementation form, the conductive microstrip line extends towards a first longitudinal direction, and wherein the non-conductive slot is elongated and extends towards a second longitudinal direction which is perpendicular to the first longitudinal direction.

According to an implementation form, the non-conductive slot is a recess in a conductive material.

According to an implementation form, the broadened end portion is formed to guide the RF wave towards the non-conductive slot.

According to a further aspect, the invention relates to a waveguide arrangement comprising the microstrip coupler and a RF waveguide enclosing the non-conductive slot to receive the emitted RF wave.

According to an implementation form, the RF waveguide comprises a conductive wall surrounding a dielectric material, and wherein the non-conductive slot is formed to emit the RF wave towards the dielectric material.

According to an implementation form, the RF waveguide comprises a conductive wall surrounding a dielectric material, and wherein the conductive wall conductively connects to the broadened end portion.

According to an implementation form, at least a portion of the broadened end portion is not enclosed by the RF waveguide.

According to an implementation form, the RF waveguide comprises a stepped portion receiving the conductive microstrip line, and an elongated portion extending perpendicularly from the conductive microstrip line.

According to an implementation form, the RF waveguide extends in a direction of a normal of the non-conductive slot.

BRIEF DESCRIPTION OF THE DRAWINGS

Further embodiments of the invention will be described with respect to the following figures, in which.

DETAILED DESCRIPTION OF EMBODIMENTS OF THE INVENTION

Figure 1:
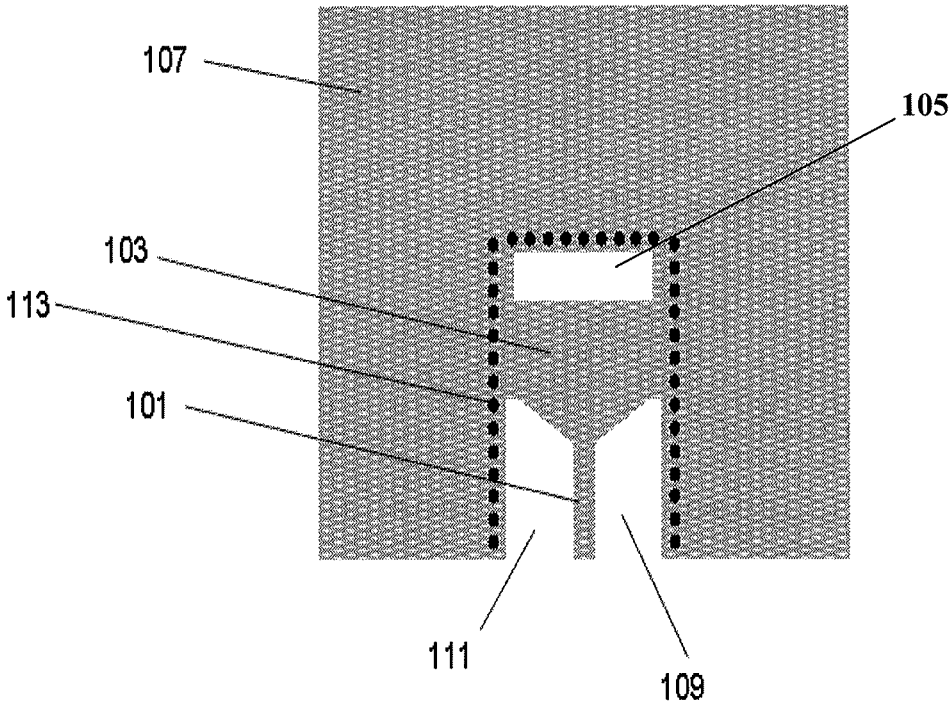
FIG. 1 shows a microstrip coupler according to an implementation form.

FIG. 1 shows a microstrip coupler for coupling an RF wave into a waveguide according to an implementation form. The microstrip coupler comprises a conductive microstrip line 101 having a broadened end portion 103. Furthermore, a non-conductive slot 105 following the broadened end portion 103 is arranged to form an antenna for emitting the RF wave which is guided by the microstrip line 101 towards the broadened end portion. The non-conductive slot 105 may be formed in a conductive plane 107 sidewards contacting to the broadened end portion 103. The conductive plane 107 must form a ground plane in which the slot 105 is formed by e.g. a recess therein.

The broadened end portion 103 may be tapered so as to provide a widening portion for guiding the RF wave towards the non-conductive slot 105. The microstrip line 101 may be arranged on a substrate having dielectric portions 109 and 111. Furthermore, a ribbon 113 of ground vias must be provided.

Figure 2:
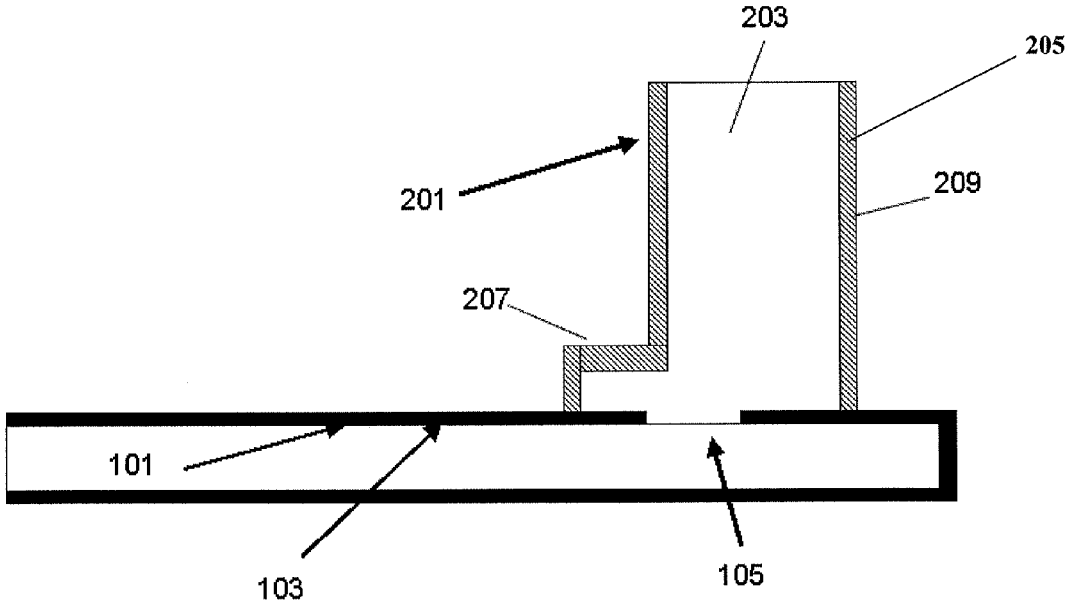
FIG. 2 shows a waveguide arrangement according to an implementation form.

FIG. 2 shows a waveguide arrangement comprising the microstrip coupler of FIG. 1 and a waveguide 201. The waveguide 201 is arranged so as to enclose the slot 105 which is emitting the RF wave towards a dielectric material 203 of the waveguide 201. The dielectric material 203 is surrounded by a conductive wall 205 which may be arranged around the non-conductive slot 105. The dielectric material 203 may be, by way of example, air. Optionally, the waveguide 201 may comprise a stepped portion 207 which receives the conductive microstrip line, and an elongated portion 209 which extends from the slot 105 in a direction of its normal, by way of example.

Figure 3:
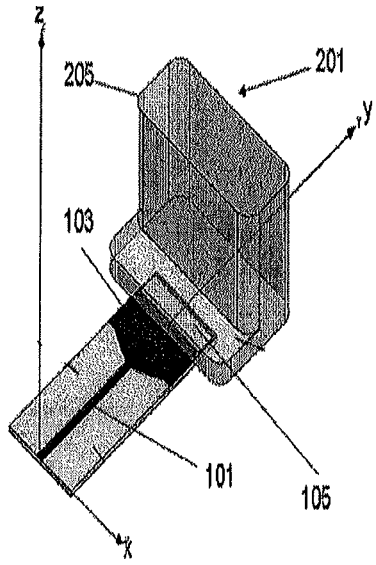
FIG. 3 shows a waveguide arrangement according to an implementation form.

FIG. 3 shows a three-dimensional view (along the X-direction, the Y-direction and Z-direction) of the waveguide arrangement of FIG. 2. As shown in FIG. 3, the microstrip line may be formed to guide the RF wave into a first direction, e.g. into the Y-direction. However, the waveguide 201 may extend in a direction which is perpendicular thereto, e.g. in the Z-direction.

Figure 4:
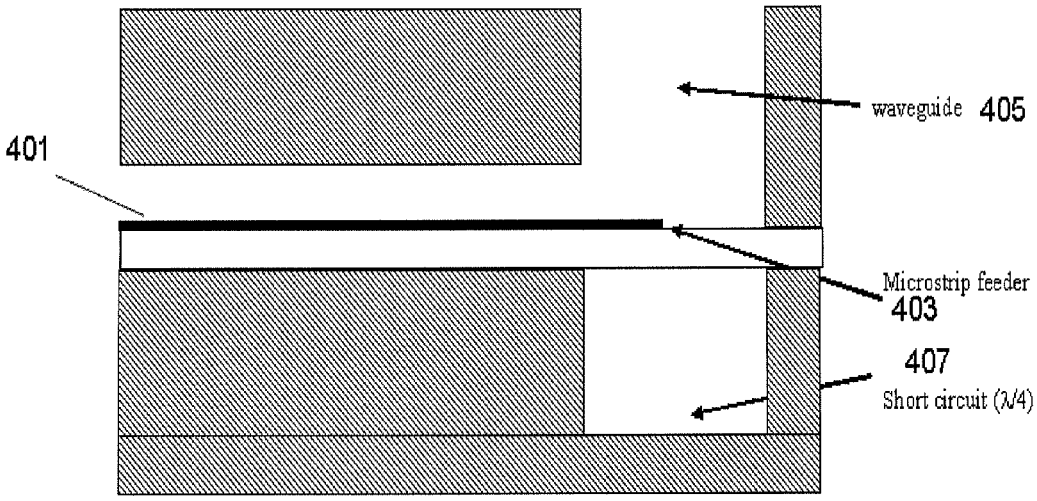
FIG. 4 shows a prior art waveguide arrangement.
Figure 5:
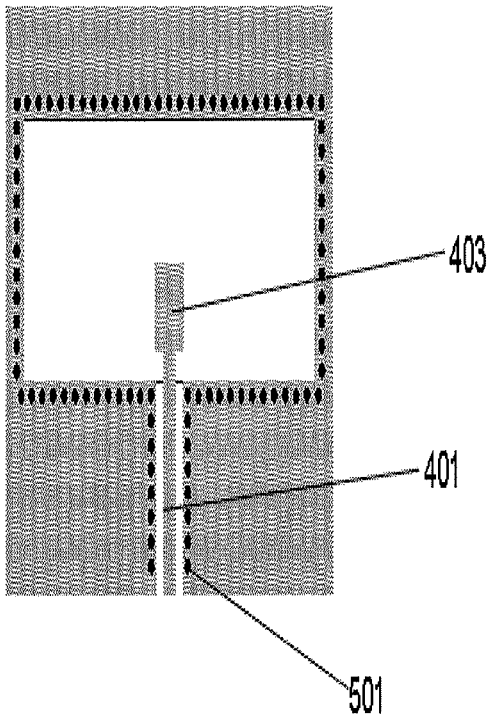
FIG. 5 shows a prior art waveguide arrangement.

With reference to FIGS. 1 to 3, the microstrip coupler provides an efficient transform arrangement for transforming the field guiding structure from a microstrip line towards a waveguide. The microstrip coupler is, according to some implementation forms, neither sensitive to mechanical assembly tolerances nor expensive during manufacturing. The presence of the non-conductive slot 105 provides, according to some implementation forms, a possibility to avoid the short $\lambda/4$ waveguide which is embedded in the arrangement of FIG. 4. Thus, according to some implementations, more flexible design for a plurality of frequency bands may be achieved. Furthermore, near the microstrip line a ribbon of ground wires is not needed anymore.

As shown in FIGS. 2 and 3, the microstrip line 101 terminates with the geometry of the taper 103 directly in contact with the cavity, which is formed by the metallic wall 205 of the waveguide 201. Thus, these tolerances of the cava positioning during the assembly step in production may be relaxed as they do not significantly affect the performance of the transition. The short circuit as shown in FIG. 1 is not required anymore as the emitted RF wave is fed directly by the microstrip coupler towards the waveguide 201.

It will be apparent to those skilled in the art that various modifications and variations can be made in the disclosed embodiments without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

The invention claimed is:

1. A waveguide arrangement, comprising:

a microstrip coupler that includes:

a conductive microstrip line having a broadened end portion, wherein the broadened end portion is tapered;

a non-conductive slot following the broadened end portion to form an antenna for emitting a RF wave; and a RF waveguide enclosing the non-conductive slot to receive the RF wave, wherein at least a portion of the broadened end portion is not enclosed by the RF waveguide.

2. The waveguide arrangement of claim 1, wherein the RF waveguide comprises a conductive wall surrounding a dielectric material, and wherein the conductive wall conductively connects to the broadened end portion.

3. The waveguide arrangement of claim 1, wherein the RF waveguide comprises a conductive wall surrounding a dielectric material, and wherein the non-conductive slot is formed to emit the RF wave towards the dielectric material.

4. The waveguide arrangement of claim 1, wherein the RF waveguide comprises a stepped portion configured to receive the conductive microstrip line, and an elongated portion that extends perpendicularly from the conductive microstrip line.

5. The waveguide arrangement of claim 1, wherein the RF waveguide extends in a direction of a normal of the non-conductive slot.

* * * * *